US006778071B2

(12) United States Patent
Megerle

(10) Patent No.: US 6,778,071 B2
(45) Date of Patent: Aug. 17, 2004

(54) ADAPTIVE ESCAPE ROUTING SYSTEM

(75) Inventor: Clifford A. Megerle, Thousand Oaks, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 43 days.

(21) Appl. No.: 10/224,552

(22) Filed: Aug. 21, 2002

(65) Prior Publication Data

US 2004/0036579 A1 Feb. 26, 2004

(51) Int. Cl.[7] ..... G08B 5/00

(52) U.S. Cl. ..... 340/332; 340/825.36; 340/825.49; 116/202

(58) Field of Search ..... 340/332, 506, 340/3.1, 825.36, 825.49; 116/67 R, 202, 200, 214

(56) References Cited

U.S. PATENT DOCUMENTS 4,531,114 A 7/1985 Topol et al.
4,709,330 A 11/1987 Yokoi et al.
4,754,266 A 6/1988 Shand et al.
5,654,690 A * 8/1997 Ishikawa et al. ..... 340/506
6,000,505 A 12/1999 Allen
6,073,575 A * 6/2000 Wotherspoon ..... 116/205
6,317,042 B1 * 11/2001 Engelhorn et al. ..... 340/539.16
6,529,128 B2 * 3/2003 Weng ..... 340/539.1

* cited by examiner

*Primary Examiner*—Daryl Pope
(74) *Attorney, Agent, or Firm*—Wallace G. Walter

(57) ABSTRACT

An adaptive escape routing system for use in buildings and building complexes in which a plurality of detectors or detector suites are situated throughout the building or building complex and provide information to a central controller as to the release of toxic, injurious, and/or agents, such as nuclear, biological, or chemical agents, in any form (including gaseous, vaporous, or particulate form). The controller, upon detection of an active sensor, commands exit and, optionally, no exit signage to designate safe exit/escape routes.

14 Claims, 9 Drawing Sheets

ADAPTIVE ESCAPE ROUTING SYSTEM

The United States government has a paid-up license in this invention and the right in limited circumstances to require the patent owner to license others on reasonable terms as provided for by the terms of Contract No. MDA972-99-3-0029 awarded by DARPA.

BACKGROUND OF THE INVENTION

The present invention relates to an adaptive escape-route system for use in a building, buildings, building complexes, and related structures in which an event, such as the release of a chemical, biological, and/or nuclear agent, requires the immediate evacuation of the building(s) or building complex in such a way that the evacuating occupants move away from the locus of the release and, more particularly, move away from the locus of the release and from any regions, areas, etc. into which the released agents may spread or disperse between the time of the initial release and the eventual full or substantially full evacuation of the building (s) or building complex.

Historically, all buildings and building complexes include emergency exit signage that point to the nearest available building exit to be used in the event of an emergency, typically a fire. Thus, when an emergency occurs, an occupant or occupants can look to the existing signage for the nearest exit, typically a fire-safe and ventilated stairwell that leads outwardly of the building. The expectation is that the occupant or occupants will be directed to an exit, typically the nearest exit, and be able to exit the building or building complex in the shortest possible time.

The nature of chemical, biological, and nuclear agent threats is such that a toxic, injurious, or lethal agent in a gaseous, vapor, aerosol, or particulate form can be released within a building or building complex at an initial location and can then spread or disperse within the building or building complex by numerous routes to one or more other locations in the building or building complex. The released agent can spread or disperse along hallways and corridors, in above-ceiling and below-floor spaces, and through various ventilation shafts and the like. More threatening, however, is dispersal through air-moving systems, including the forced-air ducting associated with fresh-air ventilation, heated-air distribution, and chilled-air distribution systems, that can move air from one location in the building to another location remote from the first location. Thus, the release of a toxic, injurious, or lethal agent at one location in the building can be distributed within the building or building complex to other, secondary locations by diffusion in the ambient air as well as by the air-handling systems.

BRIEF SUMMARY OF THE INVENTION

In view of the above, it is an object of the present invention, among others, to provide an adaptive escape routing system for use in buildings and building complexes in which the initial detection of the release of a toxic, injurious, or lethal agent causes an identification of those exits that lead away from the area of the initial release and, optionally, any areas, locations, etc. in which the released agent can spread to, disperse to, or be conveyed to during at least that period of time necessary to achieve a full evacuation of the occupants.

The present invention advantageously provides an adaptive escape routing system for use in buildings and building complexes in which a plurality of detectors or detector suites are situated throughout the building or building complex.

The detectors are designed to detect the release of toxic, injurious, and/or agents, such as nuclear, biological, or chemical agents, in any form (including gaseous, vaporous, aerosol or particulate form) and communicate their detection status to a central controller. The detector suites can also monitor air pressure, air flows, and, if desired, the detector suites can also include the capability of detecting heat/smoke associated with fire and/or the capability of detecting an explosion or ballistic impact.

The central controller, which may take the form of a programmed computer, includes information as to the location of all sensors within the building or building complex, exit or other signage, air-movement pathways within the building or building complex, and information as to pressure and pressure differentials within the building or building complex. The air-movement pathways can include, for example, hallways, corridors, above-ceiling spaces, below-the-floor spaces (typical of computer rooms), ventilation shafts, and all air-handling ducting/conduits associated with ventilation, heating, and air-conditioning systems. In addition, the central controller includes modeling software that can forward-model dispersion or dispersion patterns from the initial or primary release point to other secondary locations based upon a priori information as to the building (s) configuration.

Upon the detection of a release, the controller identifies all air-movement pathways that are "connected" to or coupled to the locus of the release (i.e., air-movement pathways into which the released agent can move) and then identifies those exits within the locus of the release. Exit signage is then identified as "don't use" signage or identified as "use-for-exit" signage. Once the "don't use" exits are identified, the central controller provides appropriate commands to the various "don't use" and "use-for-exit" signs (and, optionally, to audio annunciators) to indicate exits that lead away from the locus of the release.

Optionally, the central controller can be provided with an increment of "look ahead" capabiltiy that can forward-model the dispersal path or paths of any gaseous, vaporous, aerosol, or particulate release during the period of time in which complete evacuation can be expected and designate those exits that have a higher probability of "connecting" to the modelled dispersal pattern as "don't use" exits. The identification of the exits in the projected dispersal path or pattern thus creates a set of 'buffer' exits between those "don't use" exits identified immediately after a release and those exits most likely to remain safe during that time period necessary to achieve a full evacuation of the building or building complex. The pattern of safe exit routes can be changed, in real time, based upon the on-going sensor inputs, the modeling results or both.

As a further option, the central controller can be provided with the capability of handling multiple simultaneous or near-simultaneous releases within a building or building complex and identifying the "don't use" exits and those exits having the lowest probability of exposing the evacuating occupants to the released agents from any of the different release points.

In its simplest form, the system can be used in the context of a single-story building in which the identification of dispersal pathways or patterns can be addressed as a two-dimensional problem. In more sophisticated contexts, the system can be used in large multi-story buildings or in building complexes in which multiple buildings may be interconnected by shared concourses, basements and sub-basements, underground parking garages, and above-ground skyways or walkways. In these more sophisticated contexts, the identification of dispersal pathways or patterns can be addressed as a three-dimensional problem.

Other objects and further scope of applicability of the present invention will become apparent from the detailed description to follow, taken in conjunction with the accompanying drawings, in which like parts are designated by like reference characters.

DESCRIPTION OF THE INVENTION

Figure 1:
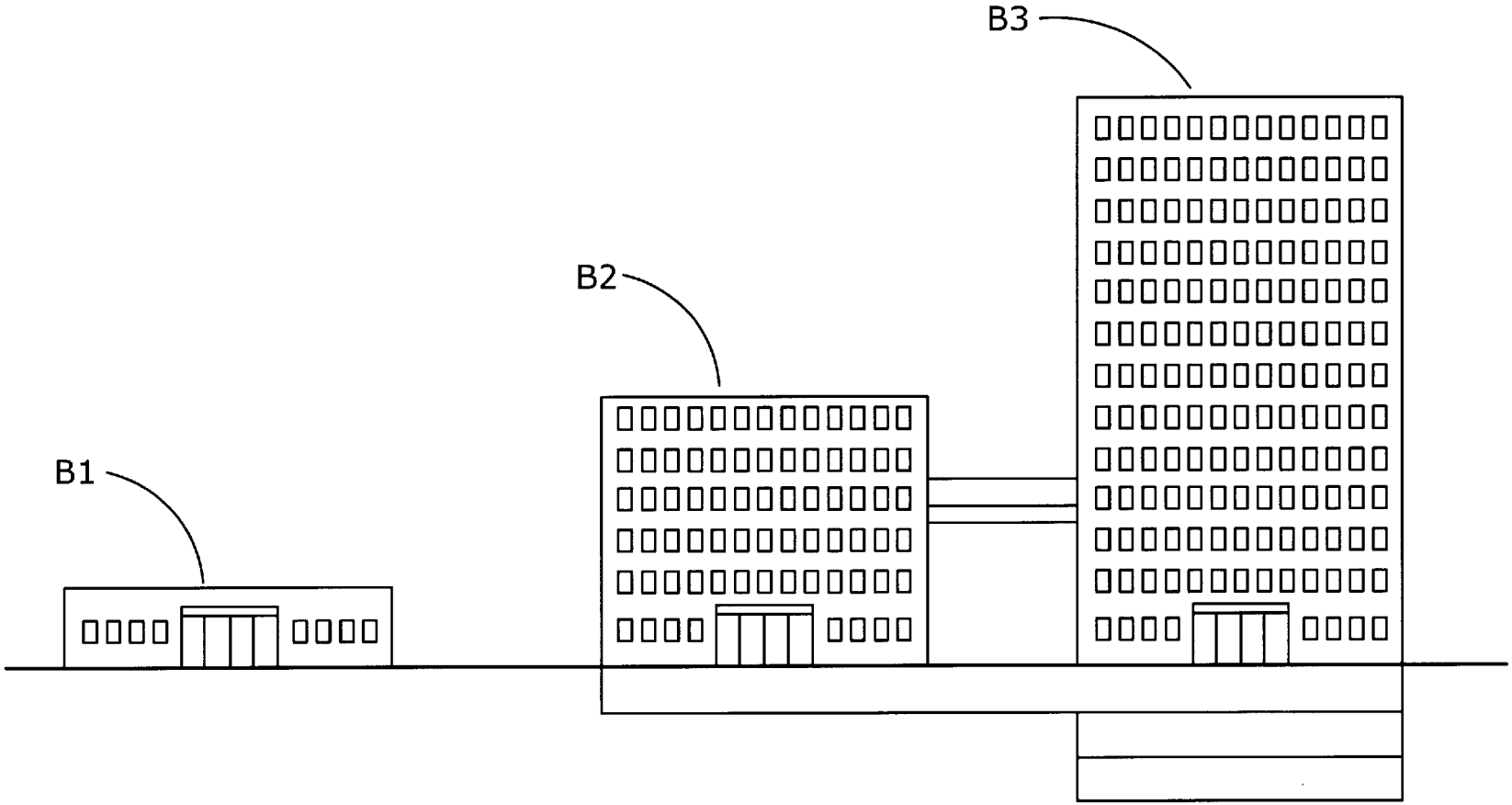
FIG. 1 is an idealized view of a multi-building complex in which some of the buildings within the complex share common air-movement spaces.

The present invention is intended for use in designating escape routes in occupied facilities including buildings and building complexes as well as in industrial facilities, mines, and ships, for example. As represented in FIG. 1, the present invention can used in the context of building structures including a single story building B1 and in multi-story buildings, such as buildings B2 and B3. In the case of buildings B2 and B3, the buildings can be connected by common spaces, such as underground concourses, basements, sub-basements, garages, etc., as well as an above-ground skywalk.

Figure 2:
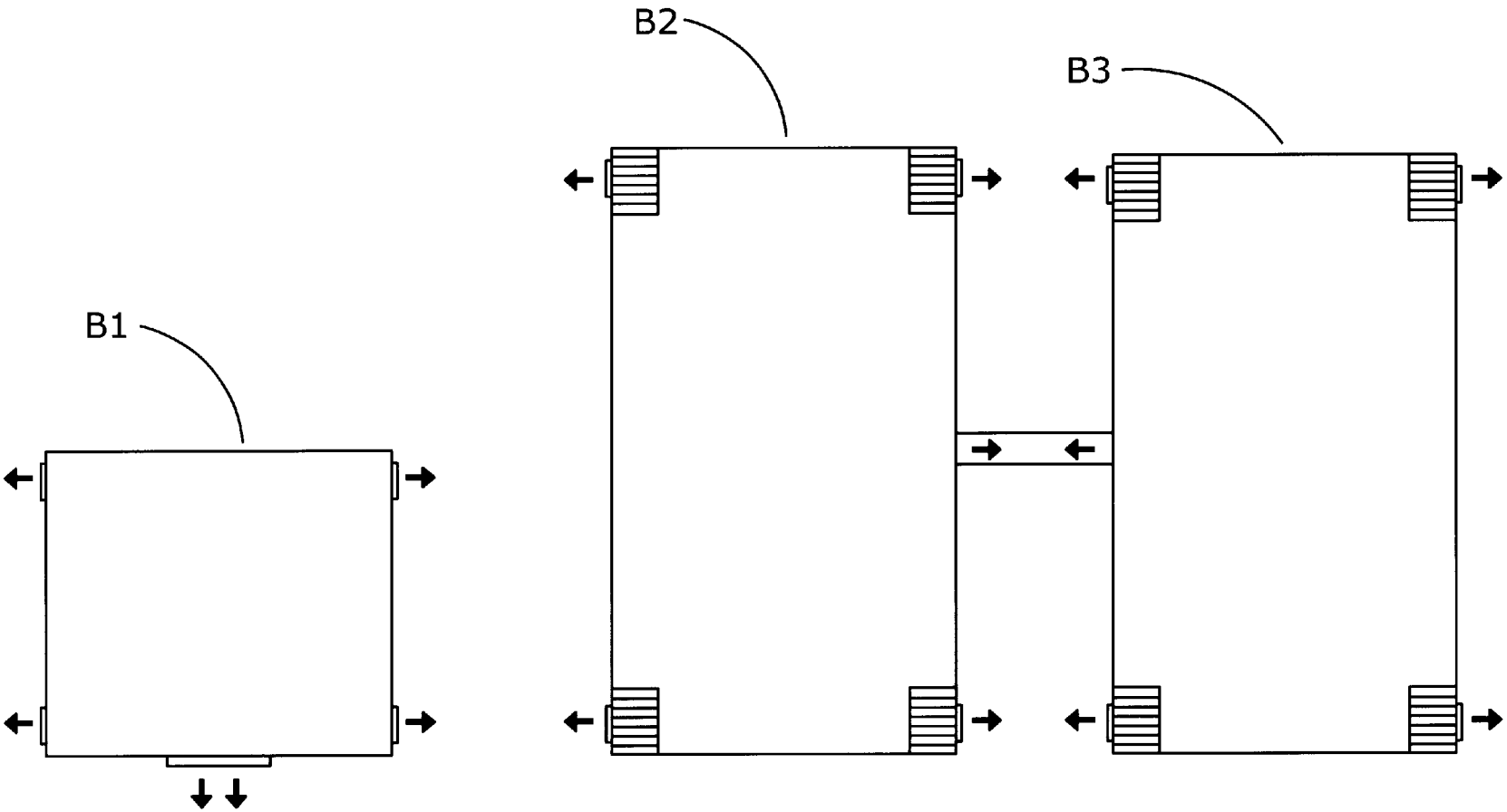
FIG. 2 is a plan view, in representative cross-section, of the building complex of FIG. 1.

As shown in the representative plan view of FIG. 2, each building has regulation-mandated exit doors or paths. For example, in the case of the single story building B1, exits are provided at each corner of the building and through the front door. In the case of an upper floor of the multi-story buildings B2 or B3, exit stairwells are provided at each corner of the building, and, in those situations where an elevated skywalk is present, the skywalk can function as an exit.

Figure 3:
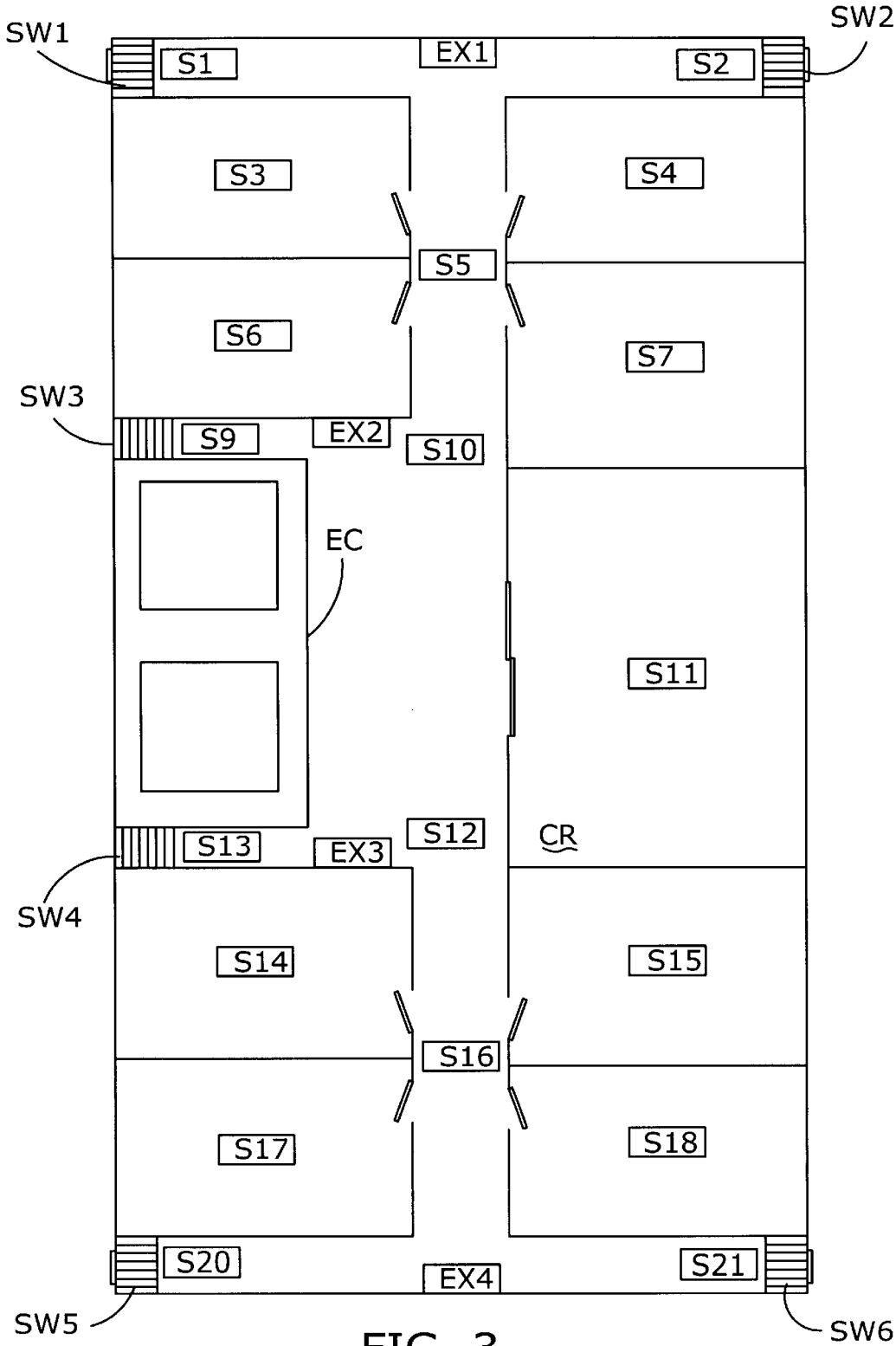
FIG. 3 is a plan view of a single floor within one of the buildings of the complex of FIG. 1.

A representative floor plan of a multi-story building is shown in schematic form in FIG. 3 and includes six stairwells SW1–SW6. As shown, stairwells SW1 and SW2 are located at the upper left and right corners, stairwells SW3 and SW4 are located on either side of the elevator core EC, and stairwells SW5 and SW6 are located in the lower left and right corners of the building.

The floor plan of FIG. 3 includes a central corridor with a lobby defined in the area of the elevator core EC and a conference room CR opposite from the elevator core EC. A total of eight offices (unnumbered) are shown with four offices on the upper side of the elevator core EC and another four offices on the lower side.

A plurality of sensors are distributed throughout the floor plan of FIG. 3 for detecting chemical and biological agents, and, optionally, smoke, flame and/or excess heat associated with fire, explosion, and/or ballistic impact. The various sensors include sensors S1 and S2 adjacent, respectively, the stair wells SW1 and SW2; sensors S3, S4, S6, and S7 in respective offices, a sensor S5 in the corridor adjacent the sensors S3, S4, S6, and S7, a sensor S9 adjacent the stairwell SW3, a sensor S10 in the upper part of the lobby area, a sensor S11 in the conference room, a sensor S12 in the lower portion of the lobby, a sensor S13 adjacent the stair well SW4, and sensors S14–S21 distributed in a manner similar to the above-mentioned sensors S1–S7.

Additionally, the floor plan of FIG. 3 is provided with a plurality of exit signs including exit sign EX1 in the corridor extending between sensors S1 and S2, an exit sign EX2 in the lobby between sensors S9 and S10, another exit sign EX3 in the lobby between sensors S13 and S12, and an exit sign EX4 in the corridor extending between sensors S20 and S21. Optionally and as explained below in the context of FIG. 5*a*, a "Stop-No Safe Exit" sign can also be used.

The sensors can taken various forms provided they function to detect the presence of target chemcial/biological agents or other agents for which detection is deemed desirable. In the preferred embodiment, the sensors can take the form shown in FIG. 4 and designated generally therein by the reference character 10. As shown, the sensor 10 includes a local air pressure sensor 12, a biological warfare sensor 14, and a chemical sensor 16. A blower 18 inducts ambient air for sampling through an inlet port 20. The air passes through a diverter 22 into a pre-concentrator 24, and then into duct 26 to respective sensors 16 and 14. Exhaust air is vented to the ambient atmosphere via a vent 32. An air speed sensor 34 is connected to the outside of sensor 10 to provide air-velocity information.

Figure 4:
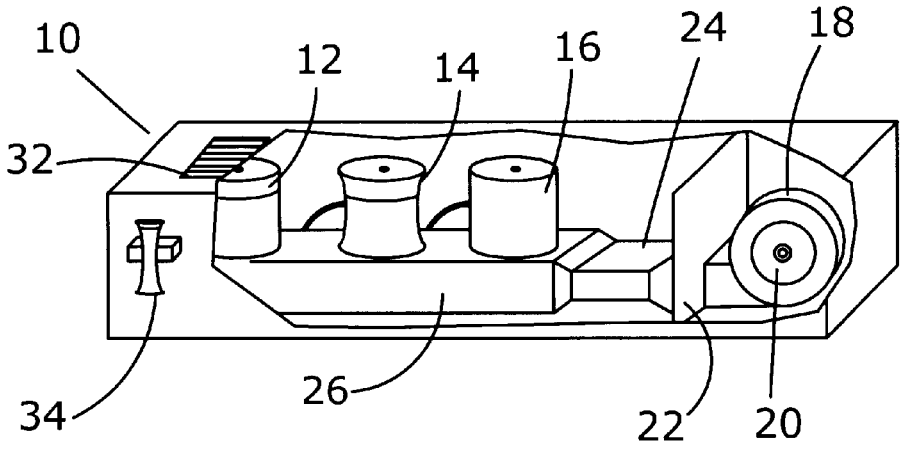
FIG. 4 is an isometric elevational view of a representative sensor with a portion thereof broken-away to show interior components.

While the arrangement of FIG. 4 shows the sensor 10 as an integrated assembly, other arrangements are suitable. For example and in some cases, the air pressure and air flow sensors can be located within air ducts while the chemical sensors can be distributed in rooms, hallways, etc. as described.

Other configurations for the sensor 10 that can sense threatening agents, air speed, and pressure are known to those skilled in the art and are within the scope of the present invention. For example, suitable chemical warfare agent sensors are available under the M-90 designation from Environics Oy of Mikkeli, Finland, and the CW Sentry designation from Microsensor Systems of Bowling Green, Ky. Suitable biological warfare agent sensors include the Joint Biological Point Detection System designation from Intellitec of Jacksonville, Fla., and the 4-Warn designation from General Dynamics of Calgary, Canada.

Chemical and biological agents and possible means to detect them are also described in co-pending U.S. patent application Ser. No. 09/969,050 filed Oct. 6, 2001, the disclosure of which is incorporated herein by reference.

Figure 5:
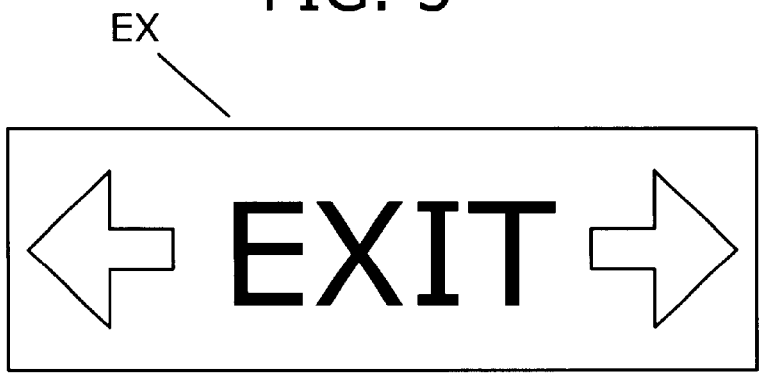
FIG. 5 is an elevational view of a conventional illuminatable exit sign with directional arrows on each end.

A front perspective view of a representative exit/alarm sign is shown in FIG. 5 and is designated therein generally by the reference character EX. As shown, the sign EX includes the word EXIT and includes opposite-pointing arrowheads laterally adjacent the word EXIT. As it customary in the art, the word EXIT is backlite by an illuminatable lamp and each of the arrowheads likewise can be backlite by an illuminatable lamp. As explained below, a central controller can selectively illuminate one or both of the arrowheads to indicate the escape route or can "darken" the entire display to indicate that the exit is a "don't use" exit. As can be appreciated, the exit/alarm sign of FIG. 5 is representative of only one of a plurality of such sign/indicators.

Figure 5A:
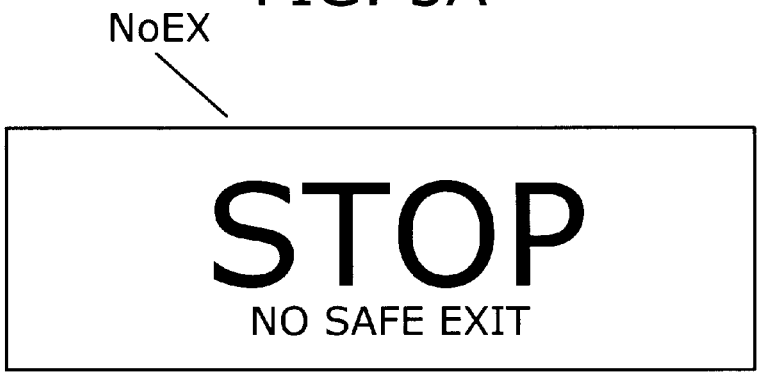
FIG. 5*a* is an elevational view of an optional "no exit" sign.

As shown in FIG. 5*a*, another type of alarm sign, designated by the reference character NOEX can include the message "Stop-No Safe Exit" (or similar message) to indicate that a particular passageway or exit is not to be used. Thus and in those instances where the sign of FIG. 5*a* is used in conjunction with the sign of FIG. 5, the sign of FIG. 5 will serve its usual purpose where that exit is identified as a "use-for-exit" sign. Conversely, where the exit is a "don't use" exit, the sign EX of FIG. 5 will be darkened (i.e., not illuminated) and the sign NoEx of FIG. 5*a* will be illuminated with its "Stop-No Safe Exit" message.

While the signs of FIGS. 5 and 5*a* are shown as two separate signs; as can be appreciated, the signs can be manufactured as a unitary or integrated structure.

Figure 6:
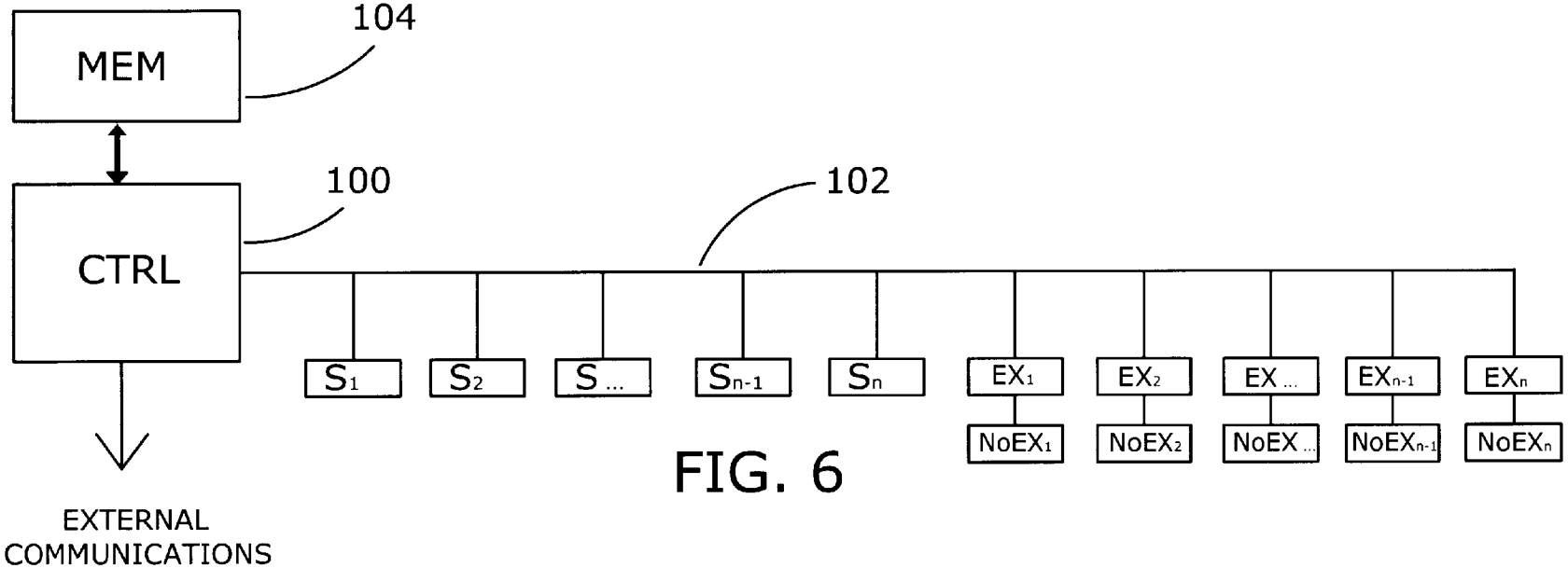
FIG. 6 is a representative topology for interconnecting the various sensors and exit signs with a central controller and its memory.

The various sensors and the signage can be interconnected in various configurations in order to implement the present invention. For example and as shown in FIG. 6, the various sensors S1, S2, S . . . , Sn-1, and Sn and the various signs, including both the exit and the "no-exit" signs, interconnect with a central controller 100 via a system-wide bi-directional communications bus 102 in which each component of the system include a serial transceiver and related A/D and D/A controllers (not shown) that allow communications in accordance with, for example, an industry-standard protocol (i.e., OSI) and sub-protocols such as the Ethernet protocol. While the global bus arrangement shown in FIG. 6 is suitable, other topologies including a ring configuration or a star configuration or combinations thereof are suitable. The central controller 100 is provided with a communications capability to communicate with the remote locations as needed. While a "hard" wire network is shown in FIG. 6 and is preferable in many applications, wireless models are likewise acceptable depending upon the particular application context.

The system of FIG. 6 includes a memory 104 that stores, among other information, the location of each sensor Sn and the signs (EXn and $NoEX_n$), the location of signs that are adjacent to a particular sensor, the direction of each directional arrow head of each exit sign in relationship to the location of each exit (e.g., each stairwell or exit door or passageway that leads thereto), and various computation sequences (as presented in FIGS. 7 and 9) for determining the best exit paths for the various possible release points within the system.

The controller 100 can take the form of a general purpose programmable computer, one or more micro-processors controlled by firmware and/or software, and/or an application specific integrated circuit (ASIC). The memory 104 can be a separate device from the controller or can be integrated into the controller 100.

Figure 7:
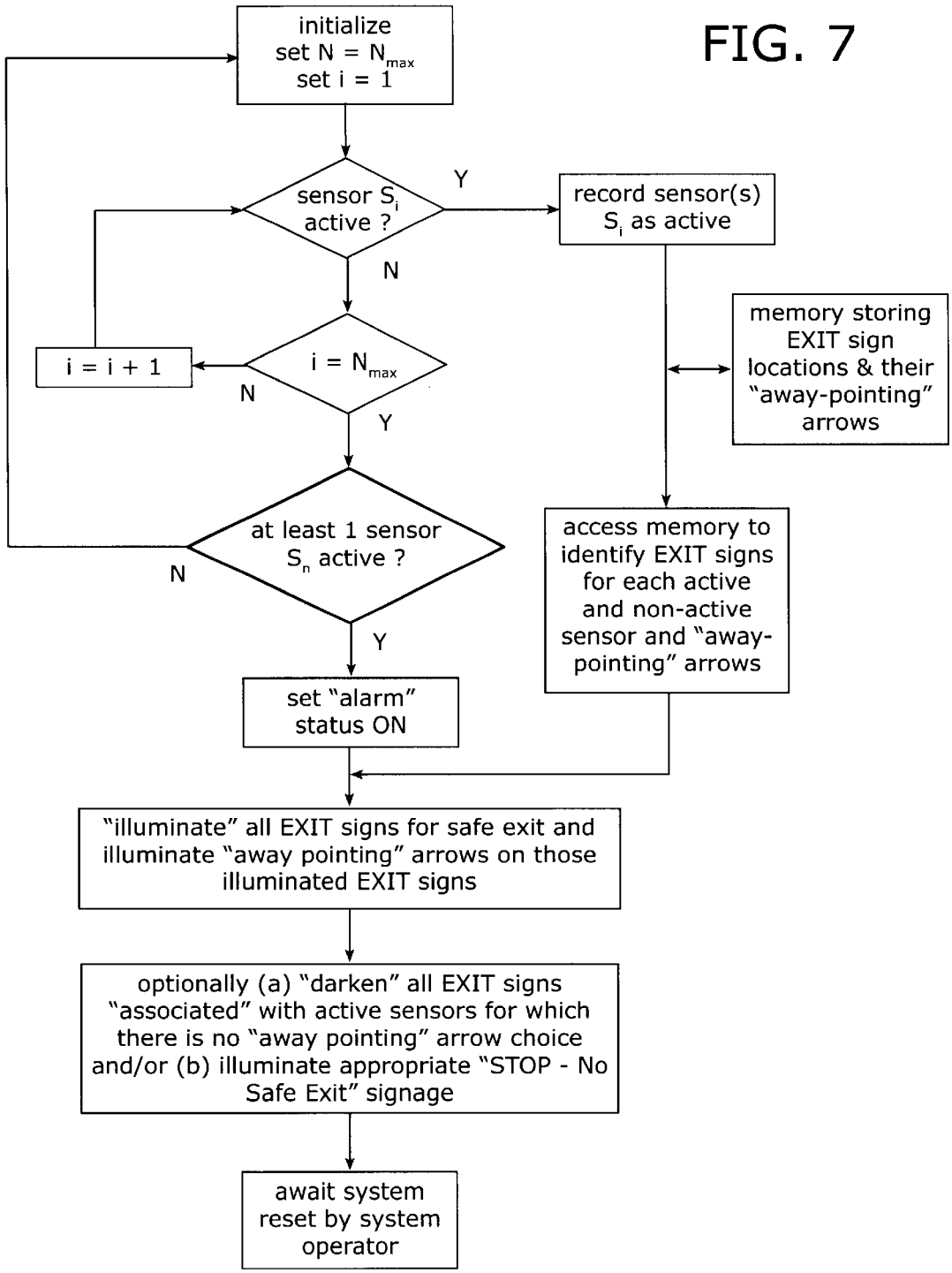
FIG. 7 is a representative process flow diagram for polling the various sensors, identifying sensors as active, and illuminating appropriate signage.

At a first level, the system can operate, for example, in accordance with the process flow diagram of FIG. 7. As shown, the system is initialized by setting a counter to an initial count (i.e, 1) and then successively polling the operating state of each sensor Sn. This polling process occurs on a sequential basis until all sensors S1, S2, S . . . , Sn-1, Sn are polled after which the polling sequence is restarted.

While a sequential polling arrangement has been presented in FIG. 7, other arrangements and variations thereof are possible including non-polling arrangements in which the central controller 100 waits in a receive mode to receive information sent from a sensor Sn when that sensor Sn enters the "active" state (i.e., upon detection of the release of a chemical or biological agent). In this latter arrangement, each sensor Sn can be assigned a time slot during which it can transmit its change in status to the controller 100 (i.e., a synchronous system) or can merely transmit its change in status as it occurs (i.e., an "asynchronous" system).

Regardless of the method by which the sensors Sn are polled or otherwise transmit their respective status to the central controller 100, that sensor or those sensors that go "active" are stored in the memory 104 and the identity of the exit signs EXn associated with that or those active sensors Sn and the remaining non-active sensors are identified along with the appropriate "away-pointing" arrows. The term "away-pointing" connotes the arrow or arrows on each of the exit signs EXn that point to, toward, or in the direction of a safer exit (or passageway to a safer exit) rather than pointing in the direction of the release. In some cases, both of the arrows on a particular exit sign EXn may be "away-pointing" arrows while in other cases both arrows may not point to or toward a safe exit route.

Once the appropriate exit signs and the particular "away-pointing" arrows are identified, the controller 100 will transmit the commands to illuminate the appropriate direction arrows on the identified exit signs to establish the exit routing.

As an option and as shown on the lower portion of FIG. 7 and depending upon the type of exit sign EXn used (i.e., the "no-exit" sign NoEx of FIG. 5*a*), the controller 100 can "darken" those exit signs EXn for which neither direction arrow is an appropriate choice for an exit route. The term "darken" means that all lamps within the exit sign are turned-off. Thus, when an occupant seeks to exit, only the 'safe' exit signs EXn with one or both directional arrows will be illuminated. As explained above, the signage can also include the FIG. 5*a* option by which a "Stop-No Safe Exit" or similar message is presented (in addition to "darkening" to conventional exit sign).

Figure 8:
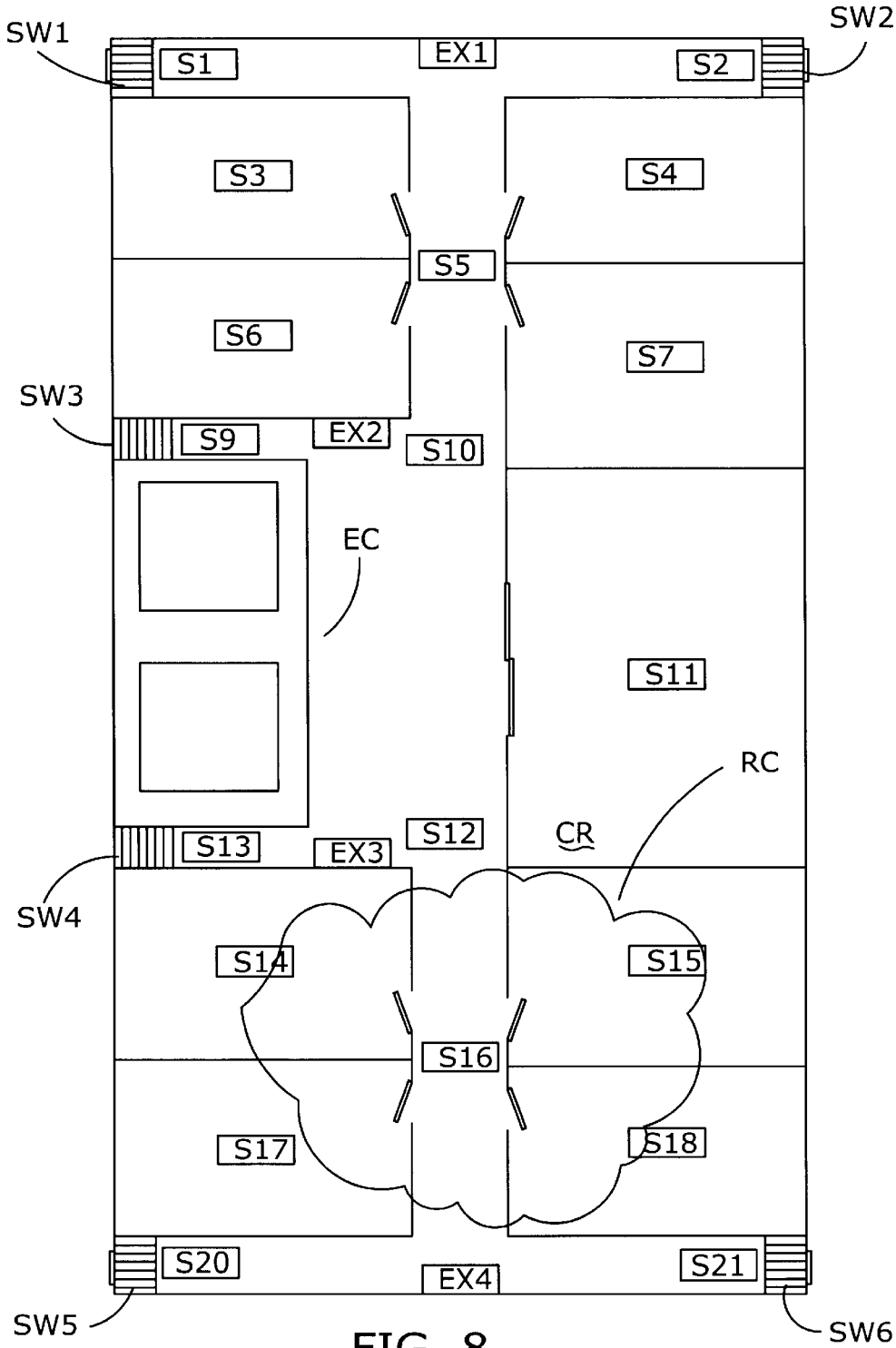
FIG. 8 is a view of FIG. 3 with a released agent forming a stylized release cloud.

FIG. 8 illustrates the operation of the process sequence of FIG. 7 in the context of the floor plan of FIG. 3 in which a release cloud RC has been generated in the lower part of the figure directly beneath sensor S16 and with sensors S14, S15, S17, and S18 also active. Upon detection of the active sensors, the procedure of FIG. 7 identifies the away-pointing arrows on exit signs EX3, EX2, and EX1 to direct the occupants away from the locus of the released cloud RC. Since a measure of judgement is involved in designating the exit signs EXn, the exit sign EX 3, for example, can be adjudged as possibly too close the released cloud and, therefor, "darkened" to minimize the probability of "vectoring" an occupant in the direction of the released cloud RC prior to directing that occupant to the stairwell SW4. In those cases with the signage of FIG. 5*a* is employed and where the exit sign EX3 is "darkened," the "Stop-No Safe Exit" signage is illuminated.

Figure 9:
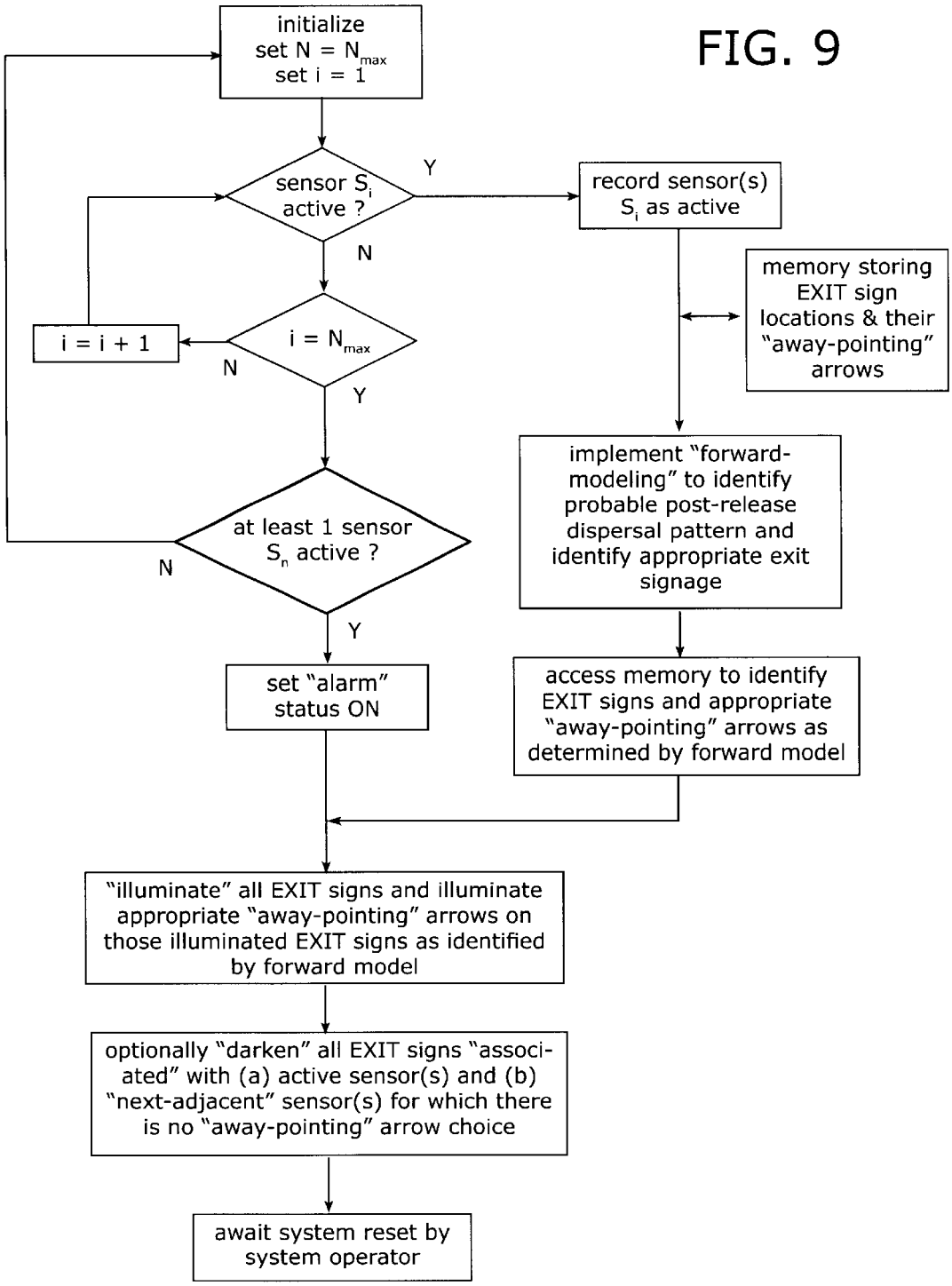
FIG. 9 is a representative process flow diagram, similar to FIG. 7, in which forward or projective modeling is used in the escape route solution.

A variant of the process or flow control of FIG. 7 is shown in FIG. 9 and illustrates the concept of "forward modelling" by which the software, for any release point or points, seeks to determine the probable near-term dispersal pattern. In FIG. 9, the controller 100 implements a "forward-model" solution as a function of known air flows, pressure differentials, and pre-identified air-movement or transfer pathways. In general, it is only necessary for the model to predict the probable 'near-term' dispersal pattern, i.e., that period of time during which the building will be substantially evacuated. Once the probable dispersal pattern has been modeled, the appropriate exit signage (including, optionally, the "Stop-No Safe Exit" signage NOEX of FIG. 5*a*) is appropriately controlled.

The forward model functions for all release situations and predicts where the released material will spread as a function of time and the adjusts the signage appropriately as time passes, even in the cases where a sensor or sensors fail. A predicted or 'anticipated" contamination zone may include, for example, areas with no sensors or areas far distant from the sensors that are initially activated by the release. Thus, the forward or projected model creates an anticipatory buffer zone based on upon the location of the initial release.

FIG. 9 illustrates the process or flow control for the modeling variant; the status of the various sensors Sn is determined and any active sensors noted. The controller 100, in cooperation with the memory 104, identifies the locations or areas deemed to be within the probable dispersal pattern as determined by the forward model. Thereafter and in a manner consistent with FIG. 7, the signage is appropriately controlled.

Figure 10:
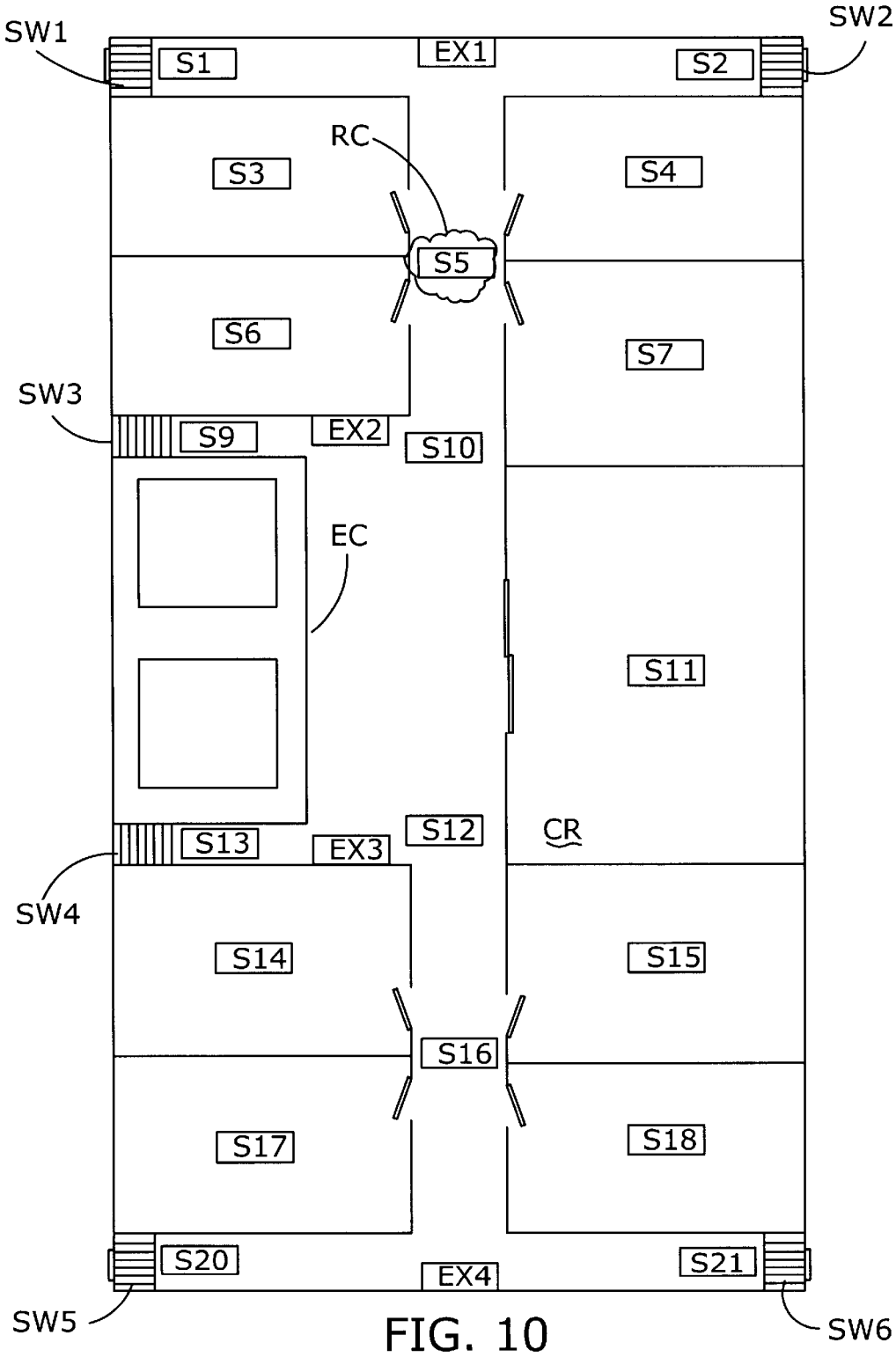
FIG. 10 is a view of FIG. 3 with a released agent forming a stylized release cloud in which forward model or projection is used in the escape route determination.

FIG. 10 illustrates the operation of the process sequence of FIG. 9 in the context of the floor plan of FIG. 3 in which a release cloud RC has been generated in the upper part of the figure directly beneath sensor S5 and with only sensor S5 active. Upon detection of the active sensor S5, the system of FIG. 9 then executes its modelling software for the probable dispersal pattern, and, in this example, identifies or treats the sensors S1, S2, S3, S4, S6, S7, and S10 as soon-to-be active; thereafter, the away-pointing arrows on exit signs EX3 and EX4 are controlled to direct the occupants away from the locus of the released cloud RC. Optionally, the exit signs EX2 and EX1 can be "darkened" to minimize the probability of "vectoring" an occupant in the direction of the released cloud RC prior to directing the occupant to the stairwell SW3. In the case where the signage of FIG. 5*a* is also used, the appropriate "Stop-No Safe Exit" sign or signs NOEX can be illuminated.

The present invention advantageously provides an adaptive escape routing system by which safe exit route(s) can be identified immediately after the detection of a release.

As will be apparent to those skilled in the art, various changes and modifications may be made to the illustrated adaptive escape routing system of the present invention without departing from the spirit and scope of the invention as determined in the appended claims and their legal equivalent.

What is claimed is:

1. An adaptive escape routing system comprising:

a plurality of sensors for sensing the occurrence of a hazardous event within a building or occupied structure, the building or occupied structure having a plurality of emergency exits and signage associated therewith; and a controller connected to the sensors for determining a subset of the exits providing a safe exit route in the event of a hazardous event, the controller, upon receiving information from one or more sensors indicating a hazardous event, accessing a memory as a function of the sensor or sensors indicating the hazardous event and determining a probable dispersal pattern for some period of time after the hazardous event is initially sensed and identifying that subset of exits providing a safe exit route as a function of the probable dispersal pattern, the controller controlling the signage to direct occupants to the subset of exits providing a safe exit route.

2. The adaptive escape routing system of claim 1, wherein the exit signage includes at least selectively illuminatable directional arrows, said controller selectively illuminating selected of the directional arrows to indicate a safe exit route.

3. The adaptive escape routing system of claim 1, wherein the exit signage includes at least a selectively illuminatable 'stop' message, said controller selectively illuminating selected 'stop' messages to indicate the absence of a safe exit route.

4. The adaptive escape routing system of claim 1, wherein the exit signage includes at least selectively illuminatable directional arrows and includes at least a selectively illuminatable 'stop' message, said controller selectively illuminating selected of the directional arrows to indicate a safe exit route and selectively illuminating selected 'stop' messages to indicate the absence of a safe exit route.

5. The adaptive escape routing system of claim 1, wherein the hazardous event includes the release of a chemical, biological, and/or nuclear in a gaseous, vapor, aerosol, or particulate form.

6. An adaptive escape routing system for a building or other occupied structure having a plurality of emergency exits, comprising:

sensor means distributed throughout the building for detecting the occurrence of a hazardous event, signage means for providing exit routing indications to occupants; and a controller connected to the sensor means for determining a subset of the exits providing a safe exit route in the event of a hazardous event, the controller, upon receiving information from one or more sensors indicating a hazardous event, accessing a memory as a function of the sensor or sensors indicating the hazardous event and determining a probable dispersal pattern for some period of time after the hazardous event is initially sensed and identifying that subset of exits providing a safe exit route as a function of the probable dispersal pattern and controlling the signage means to provide routing indications to the subset of exits providing a safe exit route.

7. The adaptive escape routing system of claim 6, wherein the signage means includes at least selectively illuminatable directional arrows, said controller selectively illuminating selected of the directional arrows to indicate a safe exit route.

8. The adaptive escape routing system of claim 6, wherein the signage means includes at least a selectively illuminatable 'stop' message, said controller selectively illuminating selected 'stop' messages to indicate the absence of a safe exit route.

9. The adaptive escape routing system of claim 6, wherein the signage means includes at least selectively illuminatable directional arrows and includes at least a selectively illuminatable 'stop' message, said controller selectively illuminating selected of the directional arrows to indicate a safe exit route and selectively illuminating selected 'stop' messages to indicate the absence of a safe exit route.

10. The adaptive escape routing system of claim 6, wherein the hazardous event includes the release of a chemical, biological, and/or nuclear in a gaseous, vapor, aerosol, or particulate form.

11. A method of determining and indicating escape routes in a building or other occupied structure having a plurality of exit ways and signage associated therewith, comprising:

sensing the occurrence of a hazardous event within the building or occupied structure; and determining a probable dispersal pattern for some period of time after the hazardous event is initially sensed and identifying that subset of exits providing a safe exit route as a function of the probable dispersal pattern and controlling the signage to direct occupants to the subset of exits providing a safe exit route.

12. The method of claim 11, wherein the exit signage includes at least selectively illuminatable directional arrows, said controlling step including selectively illuminating selected of the directional arrows to indicate a safe exit route.

13. The method of claim 11, wherein the exit signage includes at least selectively illuminatable 'stop' message said controlling step including selectively illuminating selected 'stop' messages to indicate the absence of a safe exit route.

14. The method of claim 11, wherein the exit signage includes at least selectively illuminatable directional arrows and includes at least a selectively illuminatable 'stop' message, said controlling step including selectively illuminating selected of the directional arrows to indicate a safe exit route and selectively illuminating selected 'stop' messages to indicate the absence of a safe exit route.

* * * * *